US007059472B2

(12) United States Patent
Lai

(10) Patent No.: US 7,059,472 B2
(45) Date of Patent: Jun. 13, 2006

(54) TOOLBOX

(76) Inventor: Ching-Hai Lai, No. 1, Lane 395, Sec. 1, Chung Shan Road, Changhua City (TW)

( * ) Notice: Subject to any disclaimer, the term of this patent is extended or adjusted under 35 U.S.C. 154(b) by 281 days.

(21) Appl. No.: 10/419,184

(22) Filed: Apr. 21, 2003

(65) Prior Publication Data

US 2004/0206648 A1 Oct. 21, 2004

(51) Int. Cl.
*B65D 85/28* (2006.01)

(52) U.S. Cl. ..... 206/372; 206/373

(58) Field of Classification Search ..... 206/349, 206/372–373, 374–379; 190/125, 127, 25; 220/639, 645, 646, 648, 660, 626, 62.11, 220/62.12; 43/54.1; 279/19, 19.3, 19.6, 279/71, 74, 75, 81, 82, 125, 134; 307/326; 408/9, 240, 710

See application file for complete search history.

(56) References Cited

U.S. PATENT DOCUMENTS 4,509,631 A * 4/1985 Kim ..... 194/350
4,544,051 A * 10/1985 Saltz ..... 190/124
5,533,558 A * 7/1996 Carey et al. ..... 150/105
5,562,208 A * 10/1996 Hasler et al. ..... 206/373
5,601,206 A * 2/1997 Haas et al. ..... 220/527
5,685,451 A * 11/1997 Newby, Sr. ..... 220/675
6,161,665 A * 12/2000 Hoover ..... 190/106
6,173,837 B1 * 1/2001 Marconi ..... 206/457
6,415,924 B1 * 7/2002 Lee ..... 206/459.5
6,450,333 B1 * 9/2002 McClenahan et al. . 206/315.11
6,626,295 B1 * 9/2003 Vasudeva ..... 206/373
6,662,945 B1 * 12/2003 Chang ..... 206/372
6,669,049 B1 * 12/2003 Crider ..... 220/833

OTHER PUBLICATIONS www.stanleytools.com- Fatmax 25" Professional Tool Box.*
www.customtruckandsuv.com/wheelwells.com- Wheel Well Tool Box.*

* cited by examiner

*Primary Examiner*—Derris H. Banks
*Assistant Examiner*—J Williams

(57) ABSTRACT

The present invention discloses a toolbox with reinforced structural strength and compression resistance. To increase the structural strength and compression resistance of a toolbox, an upper casing in accordance with the present invention comprises a plastic layer with a reinforced structure and such reinforced structure enhances the strength and the effect of compression resistance of the toolbox.

10 Claims, 17 Drawing Sheets

TOOLBOX

BACKGROUND OF THE INVENTION

1. Field of the Invention

The present invention relates to a toolbox with reinforced structural strength and compression resistance.

2. Description of the Related Art

The current toolbox models commonly use plastic injection and shaping for their production, of which the plastic injection and shaping is divided into hollow air-blow formation and solid formation. Please refer to FIGS. 1 and 2 for a prior-art toolbox A1, and its structure comprises an upper casing A2; a box body A3 having a recession for placing tools therein; and a latch section A4 disposed on the front end of the upper casing A2 for latching the box body. When the toolbox A1 is in use, it has the following shortcomings:

(1) General toolboxes are used to contain many tools, and the plastic toolbox may be under the pressure of a heavy load and may lack strength, and be unable to hold heavy load, and be easily affected by external forces such as collision and has the shortcoming of destroying the toolbox.

(2) The material of the plastic toolbox is fragile, and the compression resistance for the loading is small, and thus has a shortcoming of a short life for the toolbox.

In view of these shortcomings of the prior-art plastic toolbox, the inventor of the present invention based on years of experience accumulated from the engagement in the related industry conducted extensive research to resolve the aforementioned shortcomings and invented the present invention.

SUMMARY OF THE INVENTION

The primary objective of the present invention is to provide a toolbox having a reinforced structural strength and compression resistance. To increase the structural strength and compression resistance of a toolbox, an upper casing in accordance with the present invention comprises a plastic layer with a reinforced structure and such reinforced structure enhances the strength and the effect of compression resistance of the toolbox.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

To make it easier for our examiner to understand the objective of the invention, its structure, innovative features, and performance, we use the following preferred embodiments together with the attached drawings for the detailed description of the invention.

Figure 1:
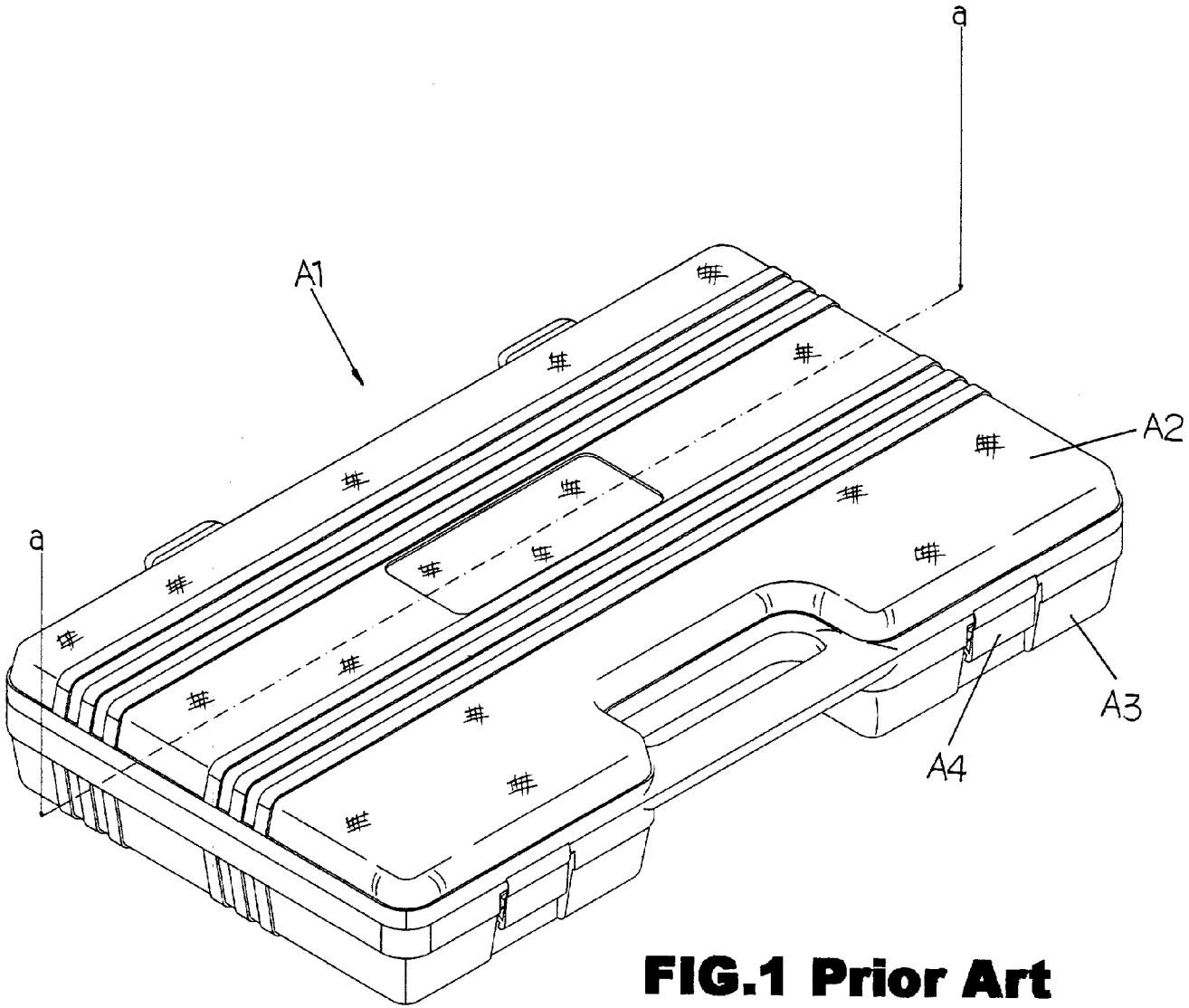
FIG.1 Prior Art
FIG. 1 is a perspective diagram of the assembled structure of a prior art.
Figure 2:
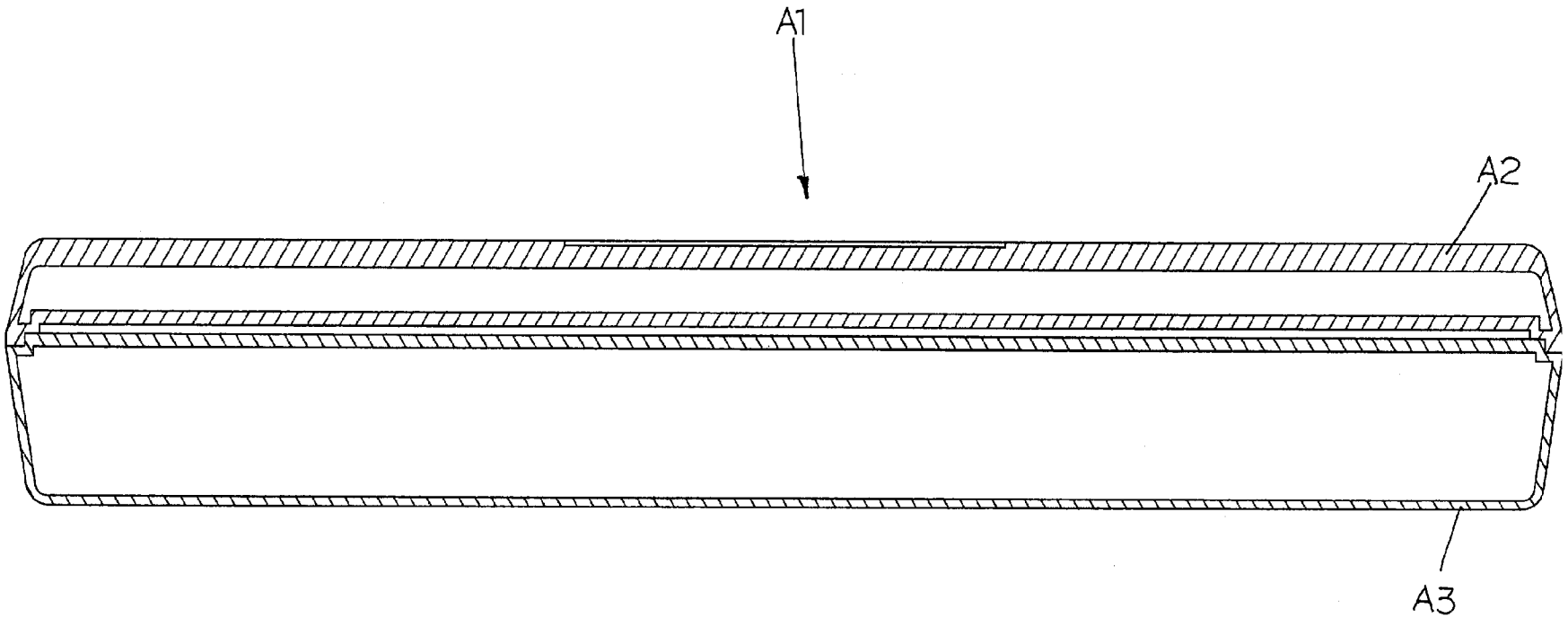
FIG.2 Prior Art
FIG. 2 is a cross-sectional diagram of a—a of FIG. 1.
Figure 3:
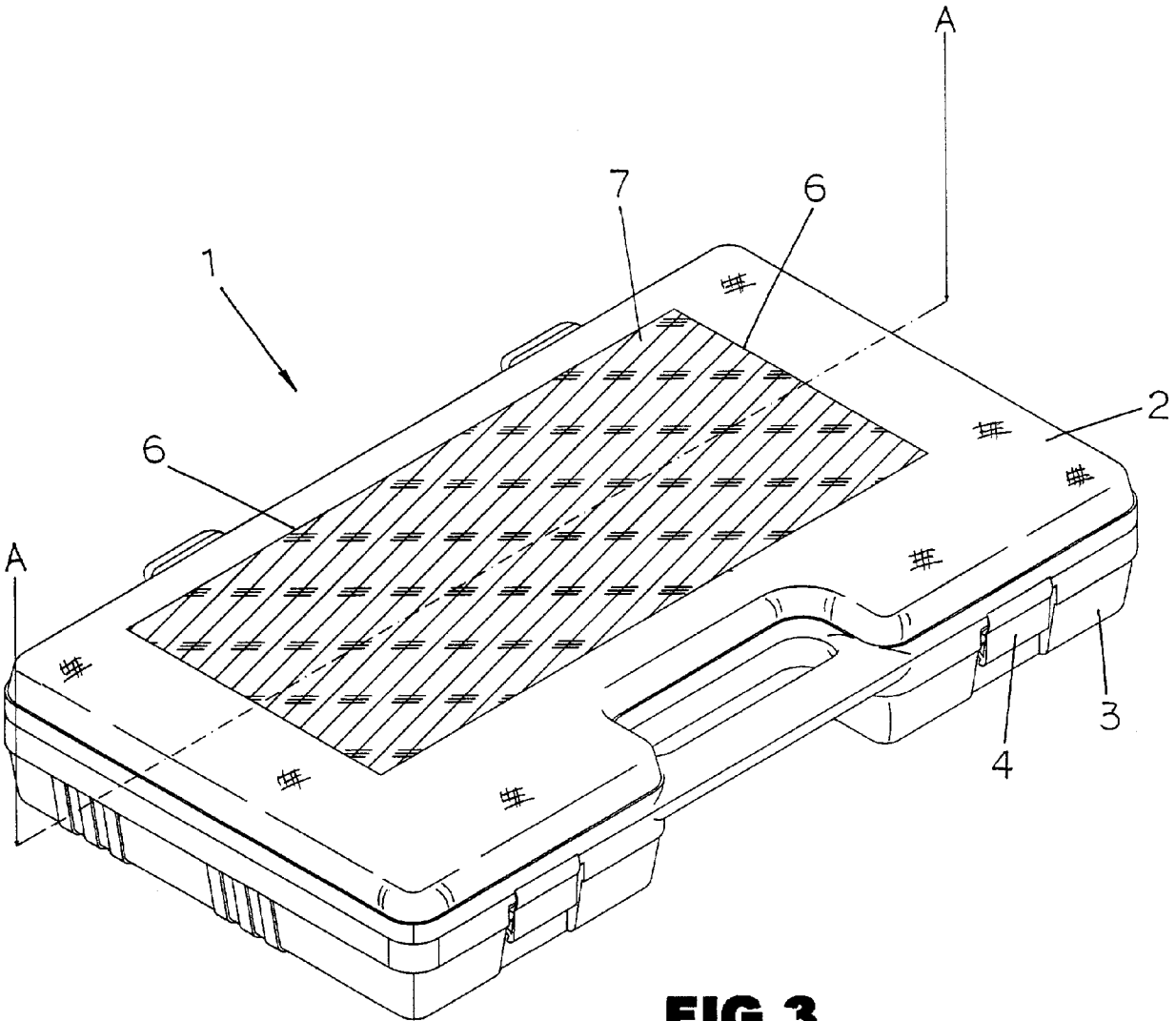
FIG. 3 is a perspective diagram of the assembled structure of the present invention.
Figure 4:
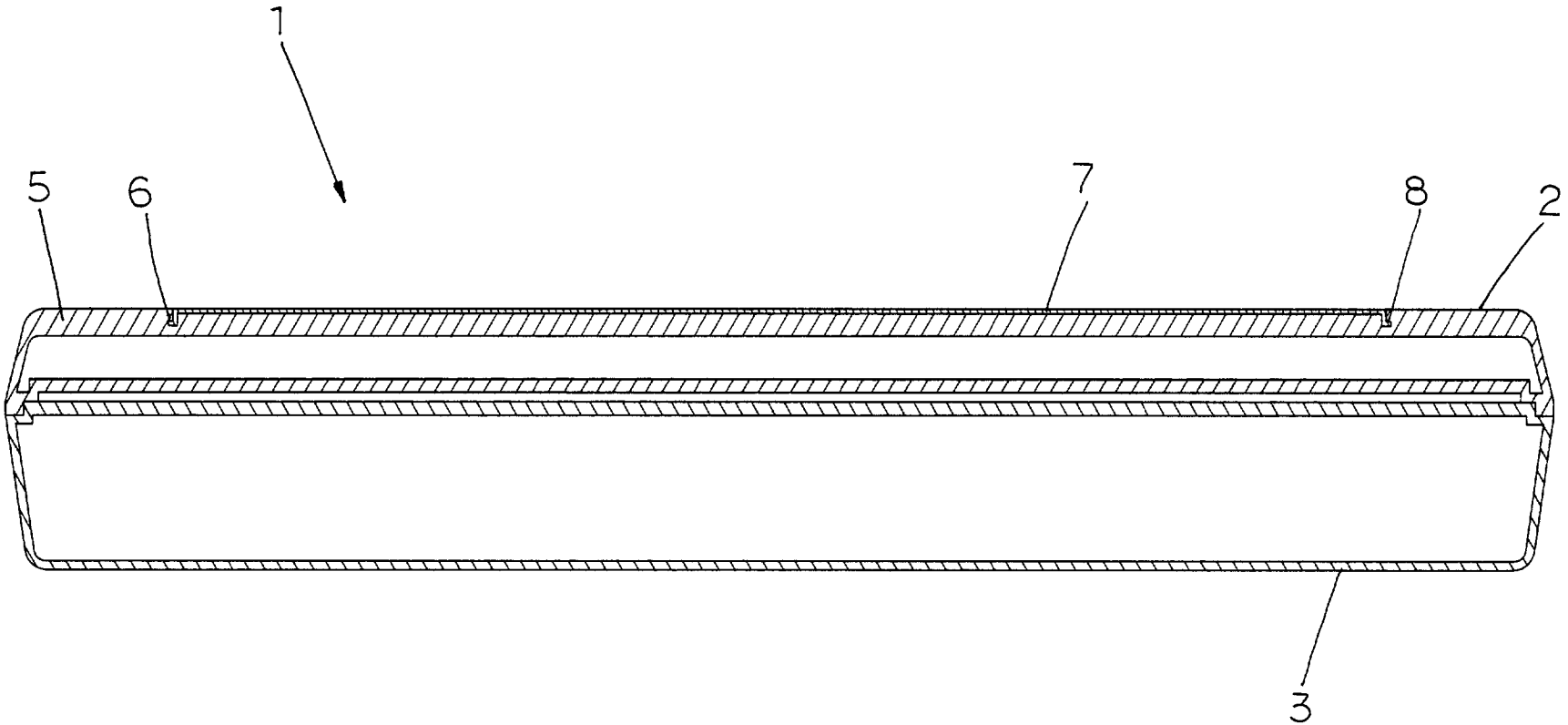
FIG. 4 is a cross-sectional diagram of A—A of FIG. 3.

Please refer to FIGS. 3 and 4 respectively for the perspective and cross-sectional diagrams of the assembled structure of the present invention.

In the figures, a toolbox 1 comprises an upper casing 2 and a box body 3; a recession is formed in the upper casing 2 and the box body 3 for placing tools; a latch section 4 is disposed at the front end of the upper casing 2 for latching the box body 3. The upper casing 2 and box body 3 are formed from a plastic layer 5. A reinforced structure 7 (i.e., a reinforcing plate) having a wrapped edge 6 is disposed on the upper casing 2 and is at least partially coated by the plastic layer 5. Such reinforced structure 7 has the effects of enhancing structural strength and improving compression resistance.

Figure 5:
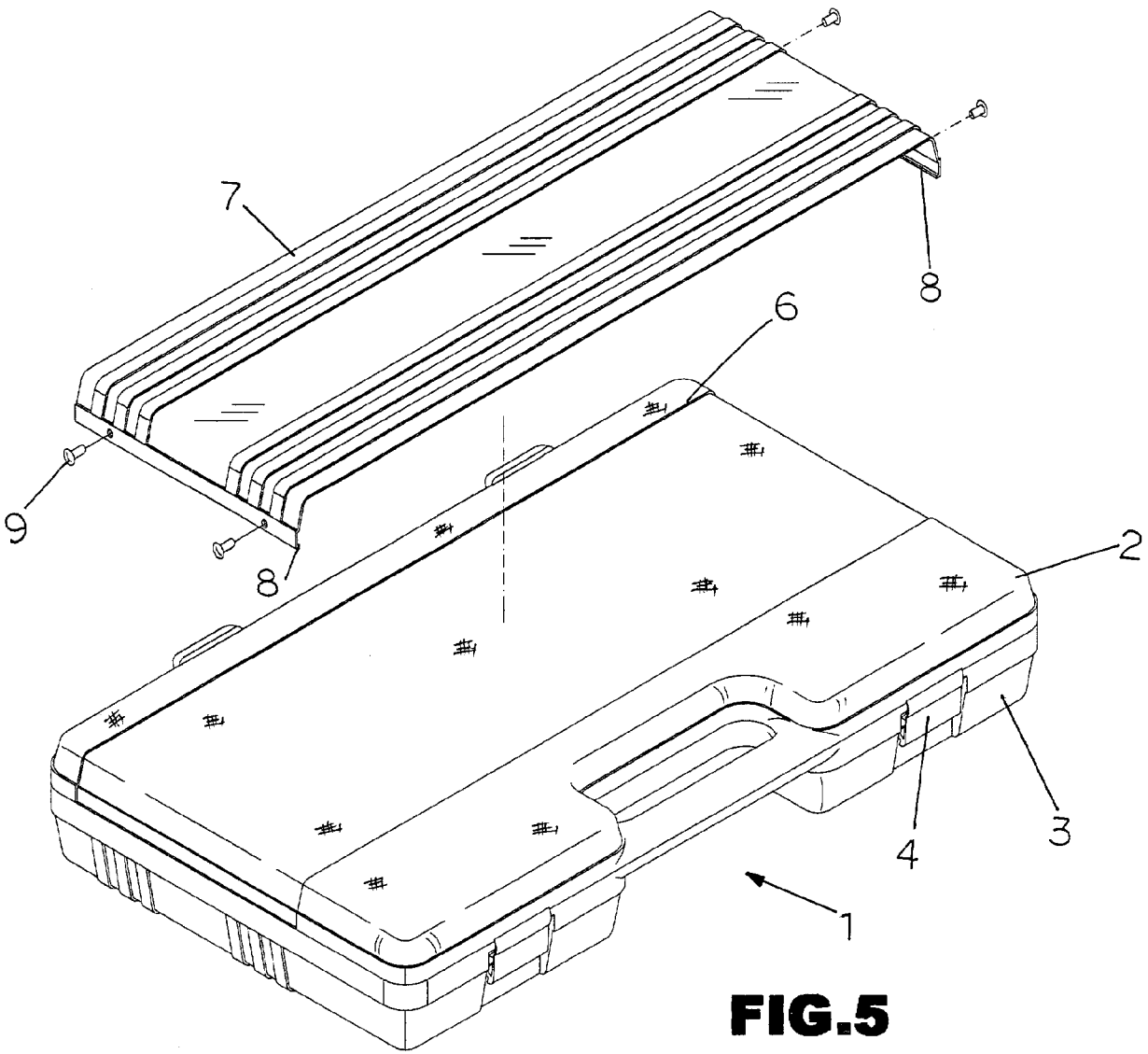
FIG. 5 is a perspective diagram of the disassembled parts of a preferred embodiment of the present invention coupled by rivets.
Figure 6:
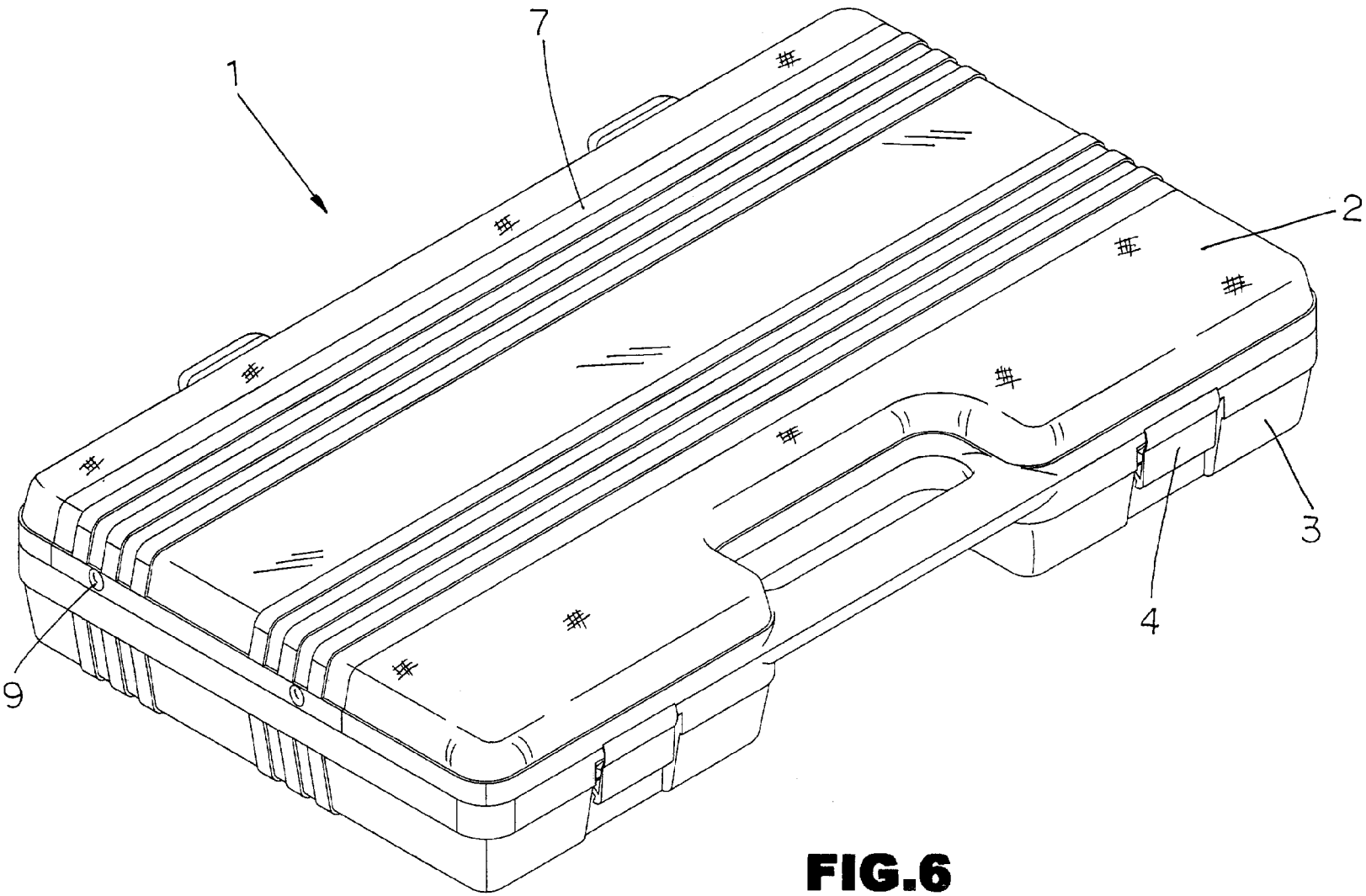
FIG. 6 is a perspective diagram of the assembled structure of a preferred embodiment of the present invention coupled by rivets.
Figure 7:
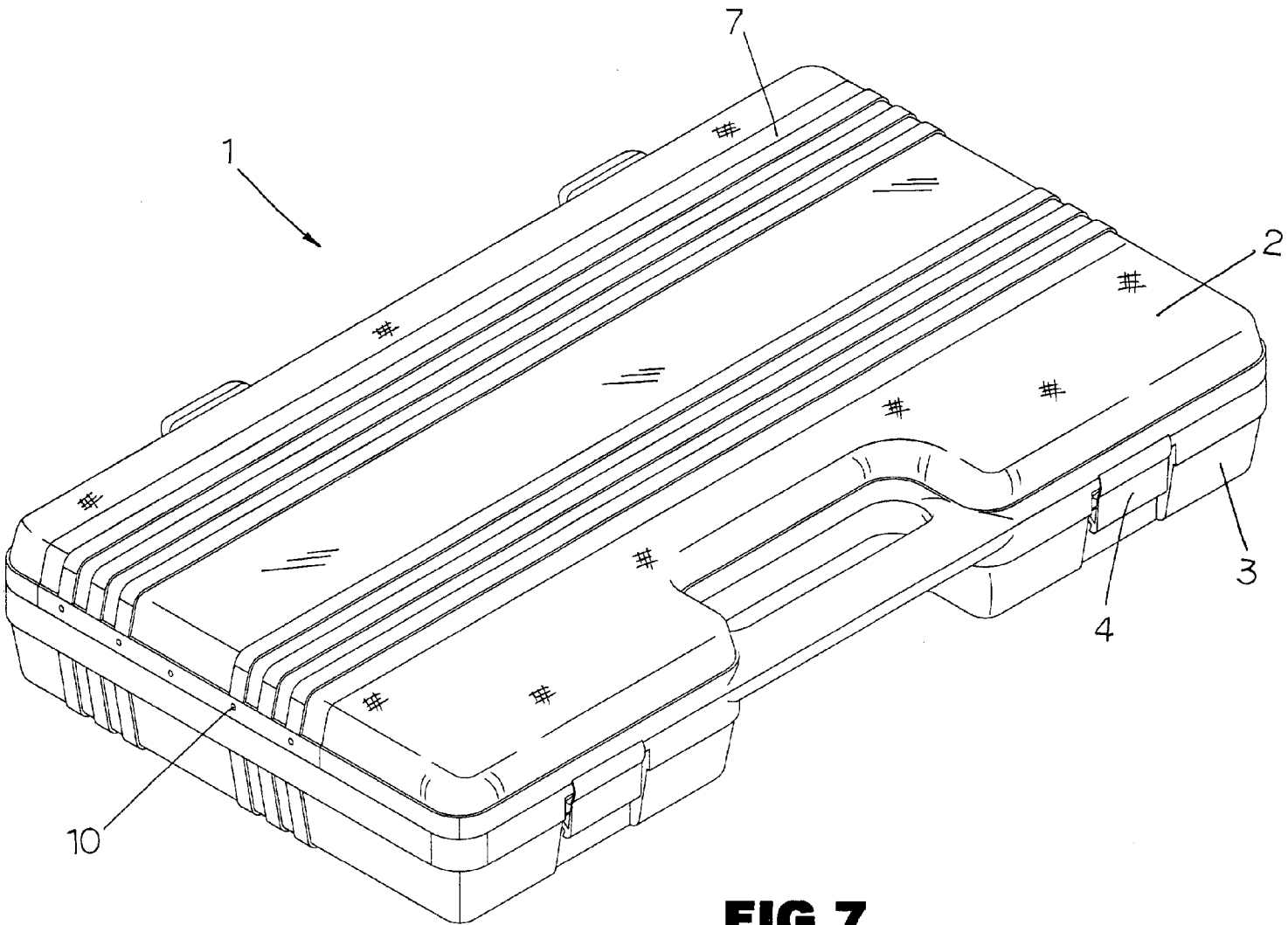
FIG. 7 is a perspective diagram of the disassembled parts of a preferred embodiment of the present invention coupled by soldering.

Please refer to FIGS. 5, 6, and 7 respectively for the perspective diagrams of the disassembled structure, assembled structure, and another assembled structure of the present invention.

In the design of another preferred embodiment of the present invention, the wrapped edge 6 of the reinforced structure 7 is secured to the upper casing 2 of the toolbox 1 by using a rivet 9 as shown in FIGS. 5 and 6, or both sides of the reinforced structure 7 are fixed by soldering as shown in FIG. 7, so that such reinforced structure 7 has the effects of enhancing the structural strength and improving the compression resistance.

Figure 8:
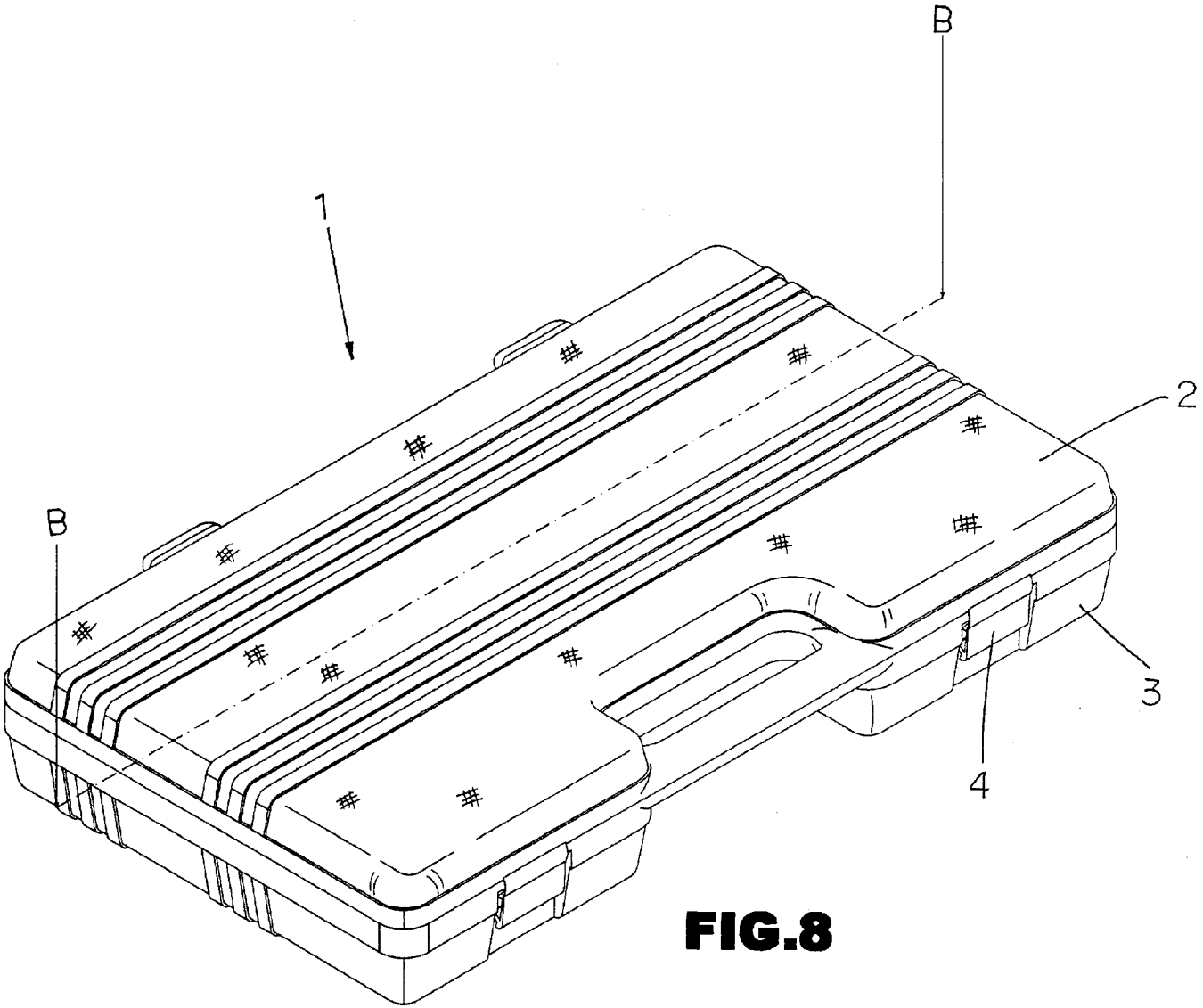
FIG. 8 is a perspective diagram of the assembled structure of a preferred embodiment of the present invention.
Figure 9:
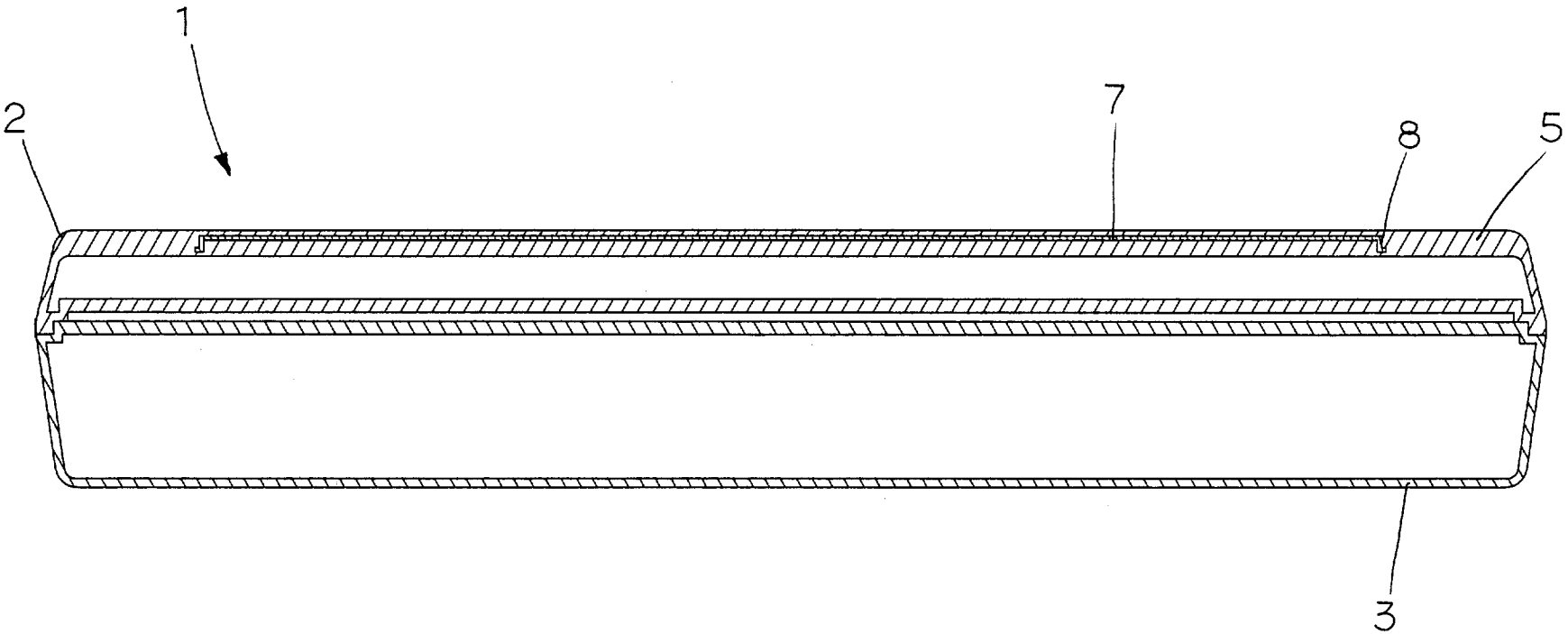
FIG. 9 is a cross-sectional diagram of B—B of FIG. 8.
Figure 10:
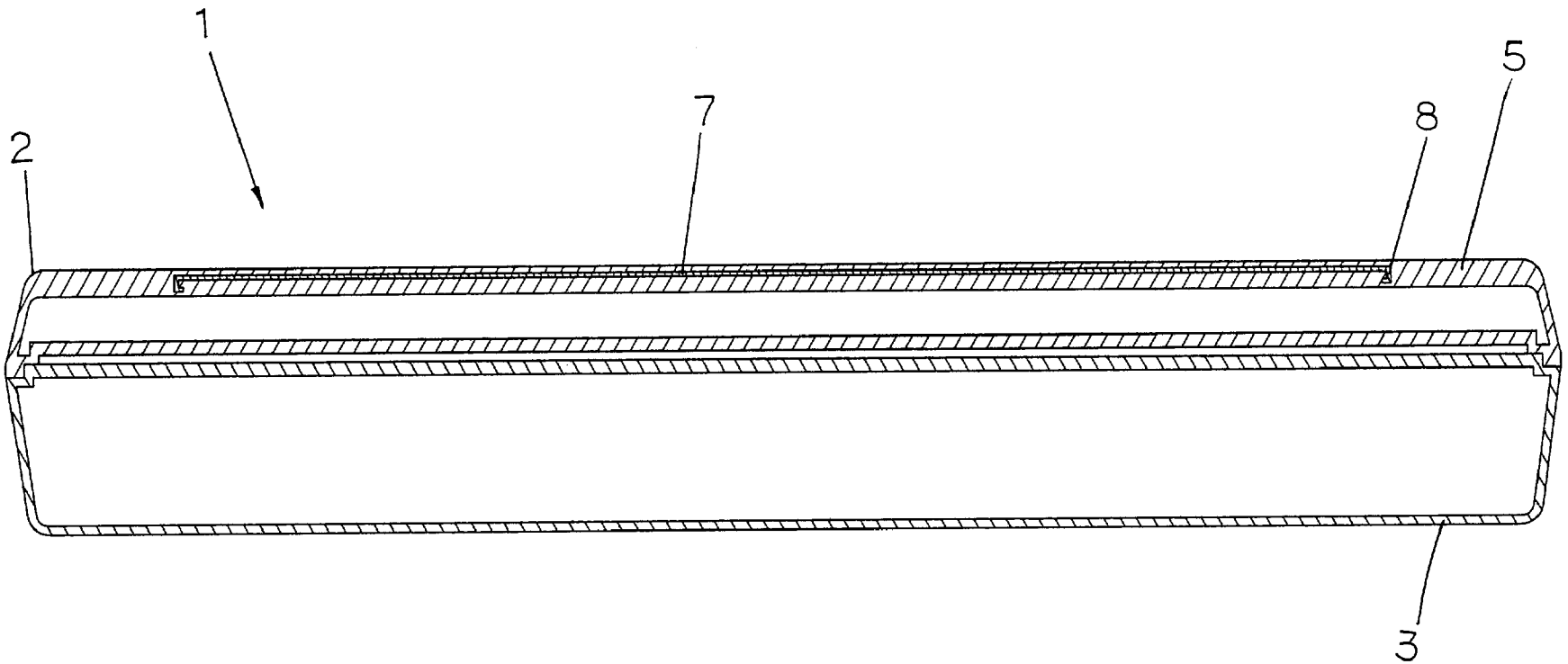
FIG. 10 is a cross-sectional diagram of B—B of FIG. 8 according to another preferred embodiment of the present invention.

Further, please refer to FIGS. 8, 9, 10 respectively for the perspective diagram of the assembled structure and the cross-sectional diagrams of the assembled structure, and another assembled structure of the present invention.

In the design of another preferred embodiment, a plastic layer with a reinforced structure forms the upper casing 2 of a toolbox 1 or a box body 3, and both ends of such reinforced structure 7 project outward to form a hook body 8 as shown in the cross-sectional diagram in FIG. 10, and the material of the reinforced structure 7 is iron sheet, aluminum sheet, stainless steel, or other hard material, so that the reinforced structure has the effect of enhancing structural strength and improving compression resistance.

Figure 11:
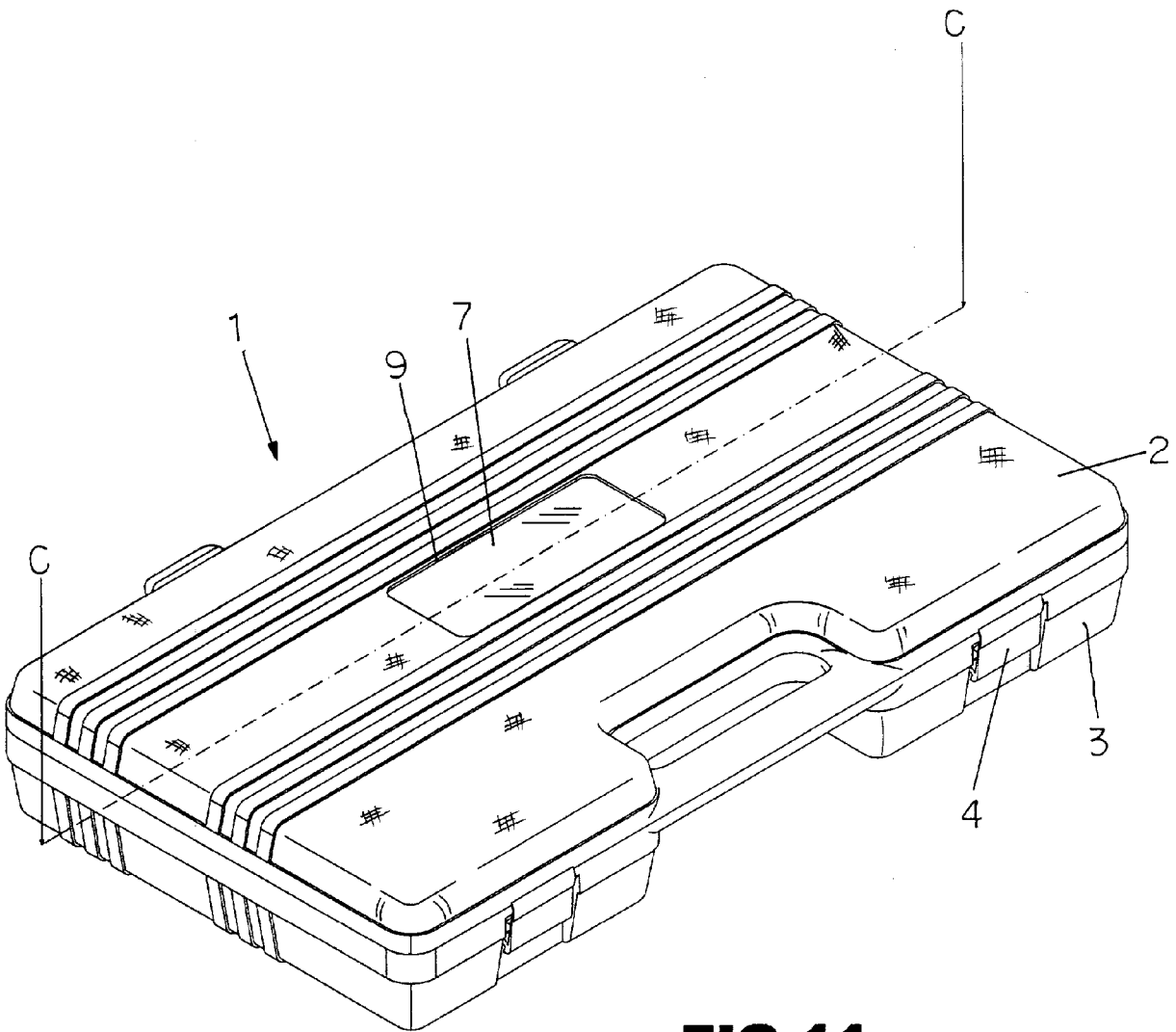
FIG. 11 is a perspective diagram of the assembled structure of another preferred embodiment of the present invention.
Figure 12:
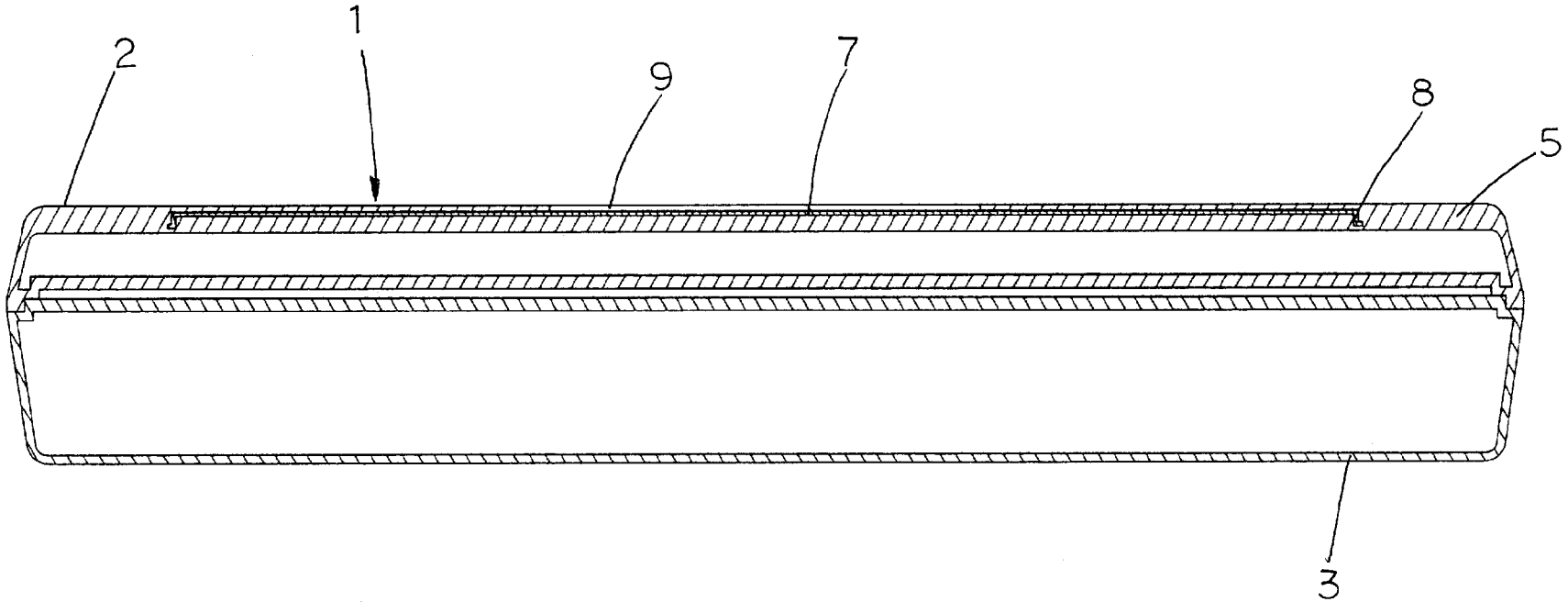
FIG. 12 is a cross-sectional diagram of C—C of FIG. 11.
Figure 13:
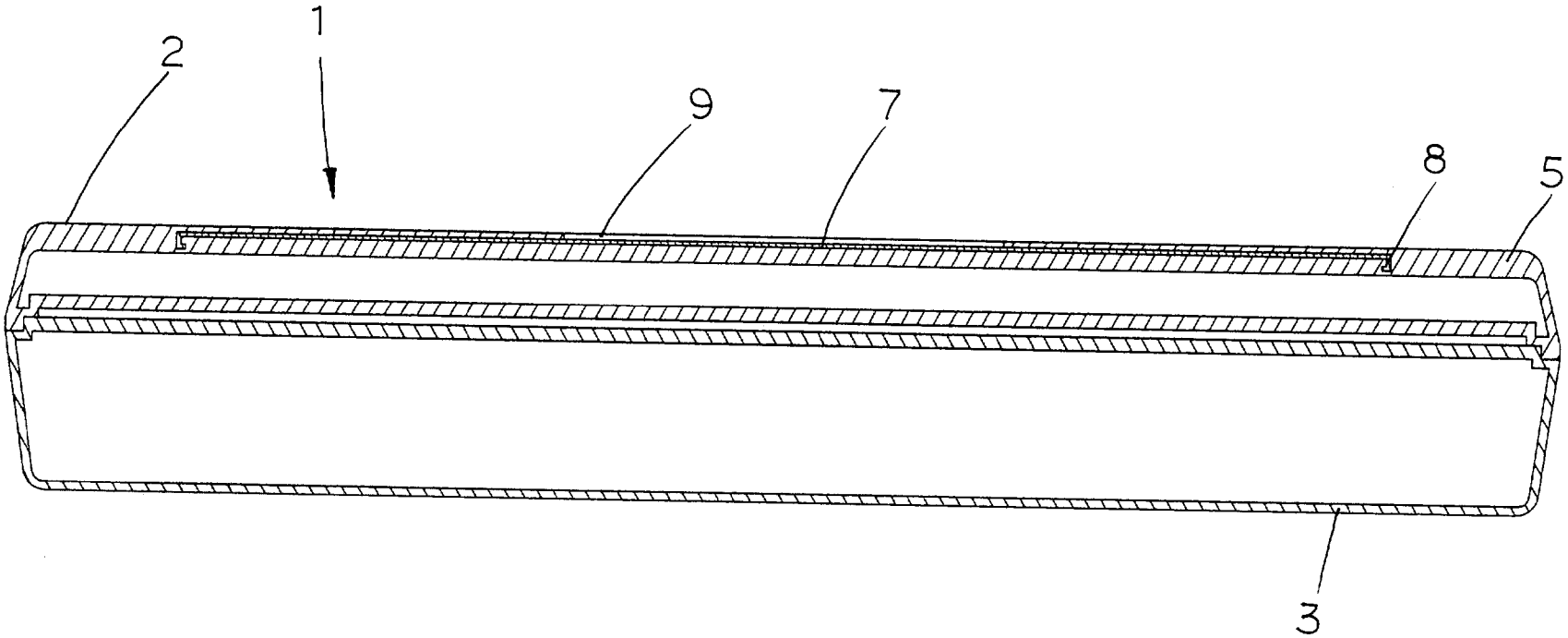
FIG. 13 is a cross-sectional diagram of C—C of FIG. 11 according to another preferred embodiment of the present invention.

Furthermore, please refer to FIGS. 11, 12, and 13 respectively for the perspective diagram of the structure, and sectional views of the assembled structure, and another assembled structure, of the present invention.

In the design of another preferred embodiment of the present invention, a hollow section (recess) 9 is formed in the plastic layer 5, and is disposed at the center of the upper casing 2, and the plastic layer 5 of the upper casing 2 of the toolbox 1 includes a reinforced structure 7 which has the effect of enhancing structural strength and improving compression resistance.

Figure 14:
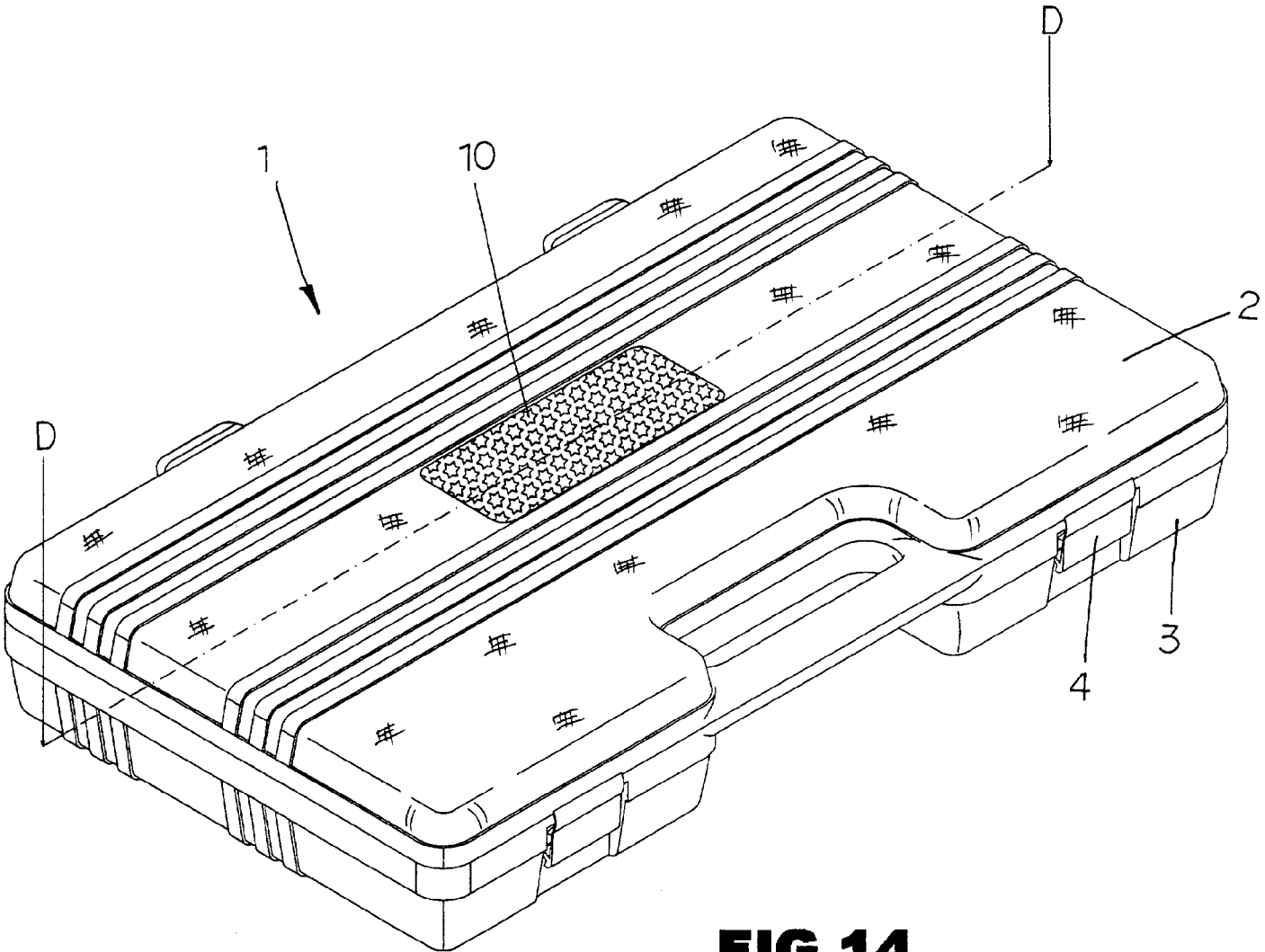
FIG. 14 is a perspective diagram of the assembled structure of another further preferred embodiment of the present invention.
Figure 15:
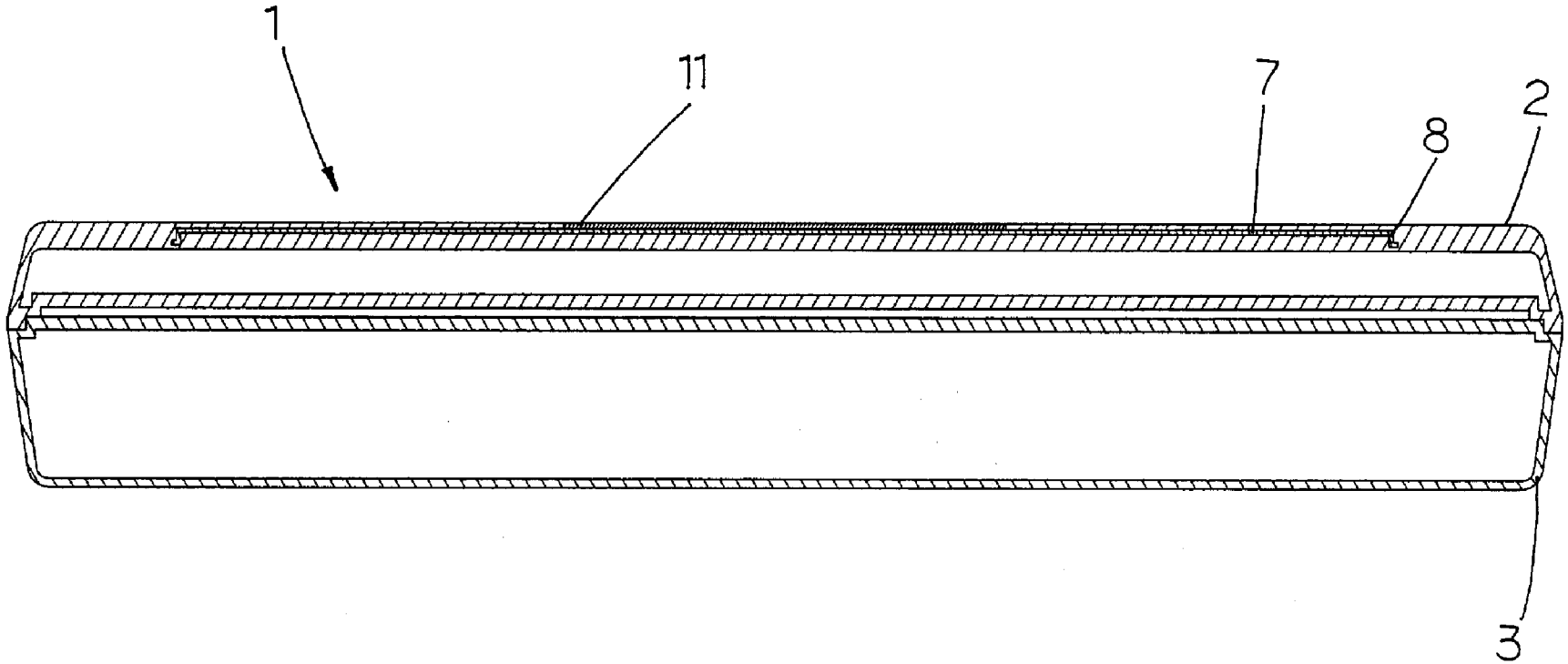
FIG. 15 is a cross-sectional diagram of C—C of FIG. 14.

Further, please refer to FIGS. 14 and 15 for the perspective and cross-sectional diagrams of the preferred embodiment of the present invention.

In the design of another preferred embodiment of the present invention, a pattern area 11 is disposed at the center of the upper casing 2, and a reinforced structure 7 is embedded in the plastic layer 5 of the upper casing 2 of the toolbox 1. The pattern area can be made of a material selected from one of the collection of a polyvinyl chloride (PVC) and an acrylic material. Such reinforced structure 7 has the effects of enhancing the structural strength and improving the compression resistance and the pattern area 11 of the toolbox 1 can be designed in different patterns to improve the artistic feeing of toolbox.

Figure 16:
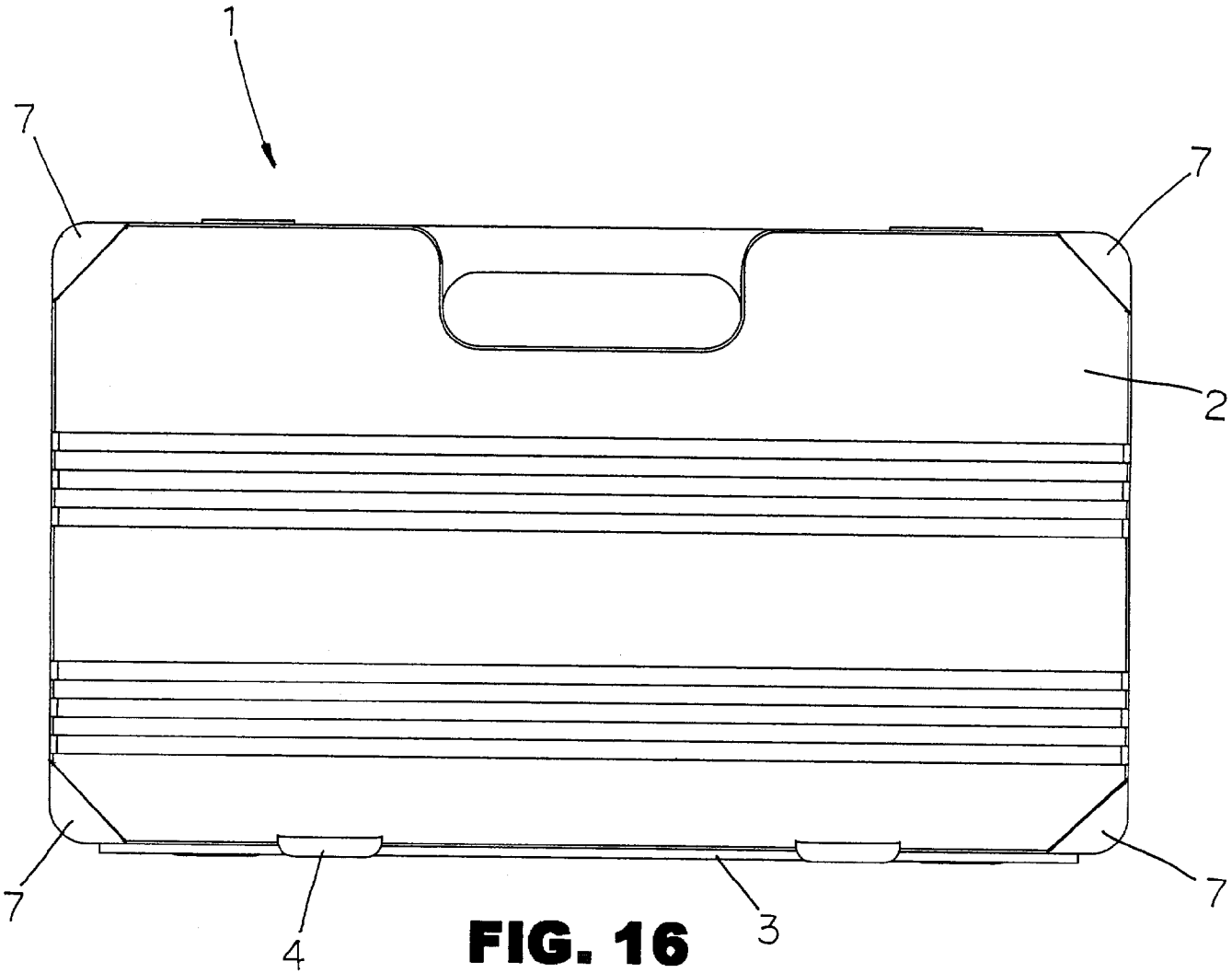
FIG. 16 is a planar view of the invention according to another further preferred embodiment.

Further, please refer to FIG. 16 for the planar illustrative diagram of the preferred embodiment of the present invention.

In the design of another preferred embodiment, the four edges of a toolbox 1 includes a reinforced structure 7, and such reinforced structure 7 can improve the effects of structural strength and compression resistance.

Figure 17:
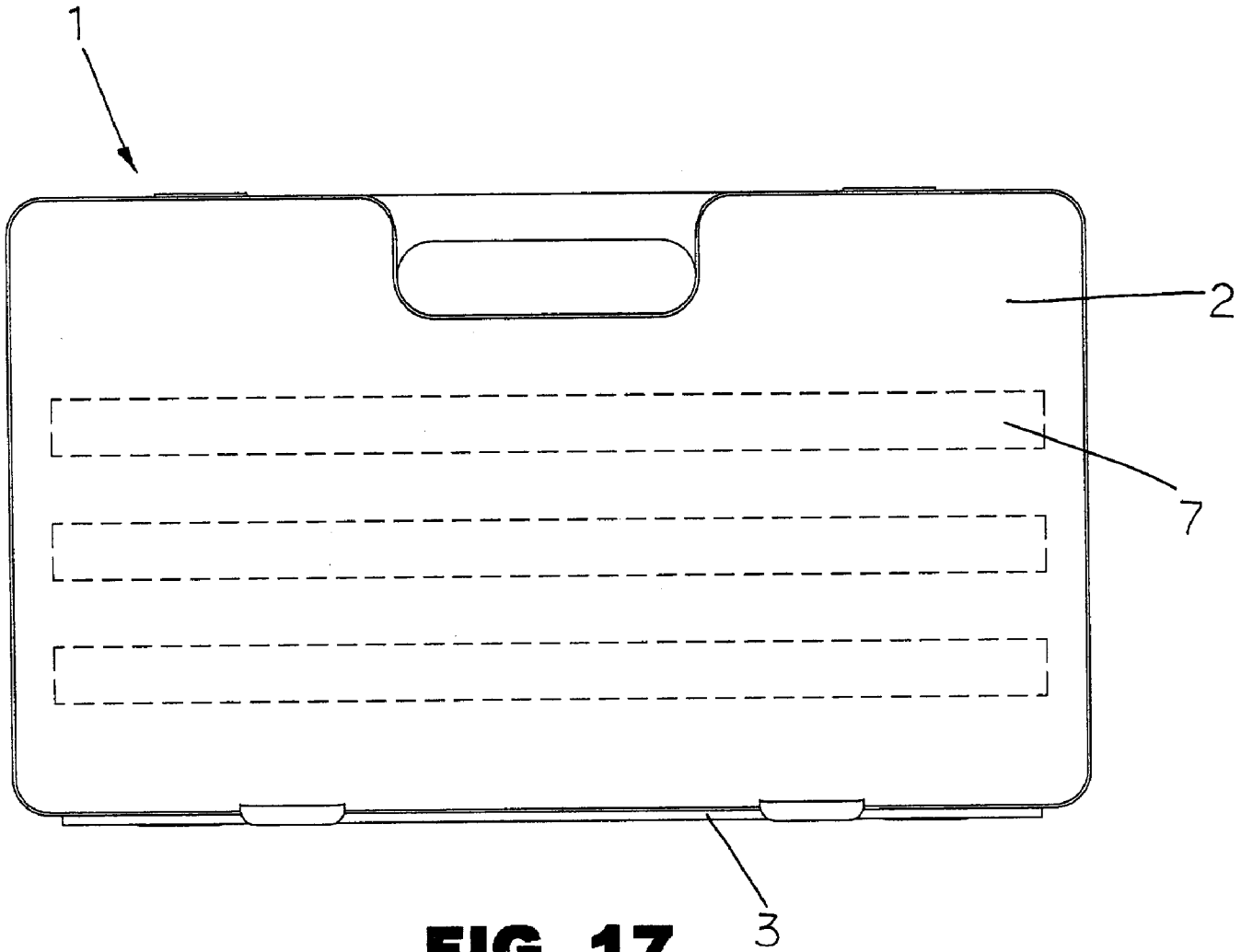
FIG. 17 is a planar illustrative diagram of a preferred embodiment of the present invention.

Further, please refer to FIG. 17 for the planar illustrative diagram of the preferred embodiment of the present invention.

In the design of another preferred embodiment, a plastic layer 5 of an upper casing 2 or a box body 3 of a toolbox 1 includes a plurality of reinforced structures, and such reinforced structures 7 can improve the effects of structural strength and compression resistance.

In view of the above description, the reinforced structure applied in different embodiments gives us the following advantages:

(1) If the reinforced structure of the present invention is added to a toolbox and the plastic layer includes a reinforced structure, the toolbox has sufficient thickness and when such toolbox contains tools or has pressure of heavy load, the toolbox can carry a heavy load and increase the strength of the structure to prevent affection by external forces that may cause damage to the toolbox.

In the design of another preferred embodiment, a plastic layer 5 of an upper casing 2 or a box body 3 of a toolbox 1 includes a plurality of reinforced structures, and such reinforced structures 7 can improve the effects of structural strength and compression resistance.

In view of the above description, the reinforced structure applied in different embodiments gives us the following advantages:

(1) If the reinforced structure of the present invention is added to a toolbox and the plastic layer include a reinforced structure, the toolbox has sufficient thickness and when such toolbox contains tools or has pressure of heavy load, the toolbox can carry a heavy load and increase the strength of the structure to prevent affection by external forces easily that may cause damages to the toolbox.

(2) Since the plastic layer of the toolbox according to the present invention includes a reinforced structure, such reinforced structure not only improves the compression resistance of the loading, but also extends the life of the toolbox.

In summation of the above description, the reinforced structural design of the toolbox in accordance with the present invention herein enhances the performance than the conventional structure and further complies with the patent application requirements and is submitted to the Patent and Trademark Office for review and granting of the commensurate patent rights.

What is claimed is:

1. A toolbox, comprising:

an upper casing;

a box body disposed under said upper casing, a recession being formed in said upper casing and said box body for placing tools, said upper casing and said box body being comprised of a plastic material;

a latch section disposed at a front end of said upper casing for latching said upper casing to said box body; and a metal reinforcing plate in contact with said upper casing, and being arranged so that its largest surfaces are in a plane that is parallel with an upper surface of said upper casing, so as to increase a strength of said upper casing, wherein said reinforcing plate is completely embedded in the plastic.

2. The toolbox of claim 1, wherein said reinforcing plate has a bar shape.

3. The toolbox of claim 1, wherein said reinforcing plate is comprised of one of an iron sheet, an aluminum sheet, and a stainless steel sheet.

4. A toolbox, comprising:

an upper casing;

a box body disposed under said upper casing, a recession being formed in said upper casing and said box body for placing tools, said upper casing and said box body being comprised of a plastic material;

a latch section disposed at a front end of said upper casing for latching said upper casing to said box body; and a metal reinforcing plate in contact with said upper casing, and being arranged so that its laraest surfaces are in a plane that is parallel with an upper surface of said upper casing, so as to increase a strength of said upper casing;

wherein said reinforcing plate has opposing ends that project outward or inward to define a hook body.

5. The toolbox of claim 4, wherein said reinforcing plate is fixed to said upper casing by a rivet.

6. The toolbox of claim 4, wherein said reinforcing plate is embedded in the plastic material of the upper casing.

7. The toolbox of claim 6, wherein said upper casing has a recess at a center thereof, the reinforcing plate being completely embedded in the plastic except at the recess, so that the reinforcing plate is exposed at the recess.

8. The toolbox of claim 4, wherein said upper casing has a pattern area at its center and said pattern area is made of a material selected from one of the collection of a polyvinyl chloride (PVC) and an acrylic material.

9. The toolbox of claim 8, wherein said pattern area at the center of the upper casing has various patterns.

10. The toolbox of claim 4, wherein the opposing ends are embedded in the plastic material.

* * * * *